US007128283B1

(12) United States Patent
Shahin

(10) Patent No.: US 7,128,283 B1
(45) Date of Patent: Oct. 31, 2006

(54) PAINT SPRAYING NOZZLE ASSEMBLY

(76) Inventor: Yousef A. Shahin, 1009 Eiffel La., Kissimmee, FL (US) 34759

( * ) Notice: Subject to any disclaimer, the term of this patent is extended or adjusted under 35 U.S.C. 154(b) by 382 days.

(21) Appl. No.: 10/769,233

(22) Filed: Feb. 2, 2004

(51) Int. Cl.
*B05B 1/00* (2006.01)

(52) U.S. Cl. ..... 239/600; 239/591; 239/596; 239/599; 239/601

(58) Field of Classification Search ..... 239/596, 239/600, 601, 604, 104, 106, 591, 592
See application file for complete search history.

(56) References Cited

U.S. PATENT DOCUMENTS

| | | | | |
|---|---|---|---|---|
| 3,659,787 | A | 5/1972 | Ito | |
| 3,876,150 | A | 4/1975 | Dwyer, Jr. et al. | |
| 3,907,202 | A | 9/1975 | Binoche | |
| 4,220,286 | A | 9/1980 | Geberth, Jr. | |
| 4,273,287 | A | 6/1981 | Huber | |
| 4,736,892 | A * | 4/1988 | Calder | 239/592 |
| 4,988,043 | A * | 1/1991 | Lechler | 239/597 |
| 5,188,290 | A | 2/1993 | Gebauer et al. | |
| 5,494,226 | A * | 2/1996 | Herstek et al. | 239/591 |
| 5,749,528 | A * | 5/1998 | Carey et al. | 239/119 |
| 6,261,367 | B1 * | 7/2001 | Donges | 118/305 |

* cited by examiner

*Primary Examiner*—Eric Keasel
*Assistant Examiner*—Jason Boeckmann

(57) ABSTRACT

A paint spraying nozzle assembly includes a housing having a top wall, a bottom wall a peripheral wall that has a peripheral outer shoulder such that the bottom wall has a greater diameter than the top wall. An opening extends through the bottom and top walls. The opening includes a top portion having a smaller diameter than a bottom portion of the opening. The top wall has a slot therein and the opening extends into the slot. An insert is mounted within the opening. The insert includes an upper section positioned within the top portion and a lower section positioned within the bottom portion. A bore extends through the insert and is aligned with the opening. The housing may be positioned in a retaining nut and secured against a spray gun head such that paint ejected outwardly of the spray gun travels through the bore and outward of the slot.

18 Claims, 6 Drawing Sheets

PAINT SPRAYING NOZZLE ASSEMBLY

BACKGROUND OF THE INVENTION

1. Field of the Invention

The present invention relates to spraying devices and more particularly pertains to a new spraying device for permitting high pressure paint spray nozzles to be constructed of a non-corrosive plastic material.

2. Description of the Prior Art

The use of spraying devices is known in the prior art. U.S. Pat. No. 5,749,528 describes a device that allows a user to reverse a spray tip with enhanced sealing effectiveness. Another type of spraying device is U.S. Pat. No. 3,907,202 which is adapted for withstanding paint feed pressures of 1,450 psi. Yet another such device is U.S. Pat. No. 4,273,287 which includes a nozzle aperture adapted for causing the stream of paint spray to be uniform.

While these devices fulfill their respective, particular objectives and requirements, the need remains for a tip assembly for a paint sprayer comprised of a plastic material so that the assembly is resistant to corroding. However, the use of such a material necessitates a particular design which still allows for even spraying and atomizing of the paint. Such a device should also prevent the build-up of static charge on the paint sprayer and be easily cleaned. Additionally, it is envisioned that such a device should be economically producible and lightweight in design.

SUMMARY OF THE INVENTION

The present invention meets the needs presented above by including an assembly housing comprised of a plastic material. The housing holds a nozzle tip comprised of a metallic material. The plastic housing is resistant to chemicals and prevents corrosion between the housing and insert. This allows the assembly to be used over a longer duration than conventional metal housings which corrode over time.

Another object of the present invention is to provide a new spraying device that provide a housing configuration that allows for the high pressure flow rates of paint spray guns which can reach pressures of 3,000 psi.

To this end, the present invention generally comprises a housing having a top wall, a bottom wall a peripheral wall extending between and is attached to the top and bottom walls. Each of the top and bottom walls has a circular shape. The peripheral wall has a peripheral outer shoulder therein such that the bottom wall has a greater diameter than the top wall. The housing has an opening therein extending through the bottom and top walls. The opening includes a top portion adjacent to the top wall and a bottom portion adjacent to the bottom wall. The bottom portion has a larger diameter with respect to the top portion such that an inner shoulder is defined. The top wall has a slot extending therein and along a diameter of the top wall such that the top portion of the opening opens into the slot. The housing comprises a plastic material. An insert is mounted within the opening and abuts the inner shoulder. The insert includes an upper section positioned within and having generally the same diameter as the top portion and a lower section positioned within and having generally the same diameter as the bottom portion. The bottom portion extends further away from the inner shoulder than the lower section extends from the inner shoulder. The insert has a bore extending therethrough and through the upper and lower sections. The bore is generally aligned with an axis of the opening. The insert comprises a tungsten carbide material. The housing may be positioned in a retaining nut and secured against a spray gun head such that paint ejected outwardly of the spray gun travels through the bore and outward of the slot.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
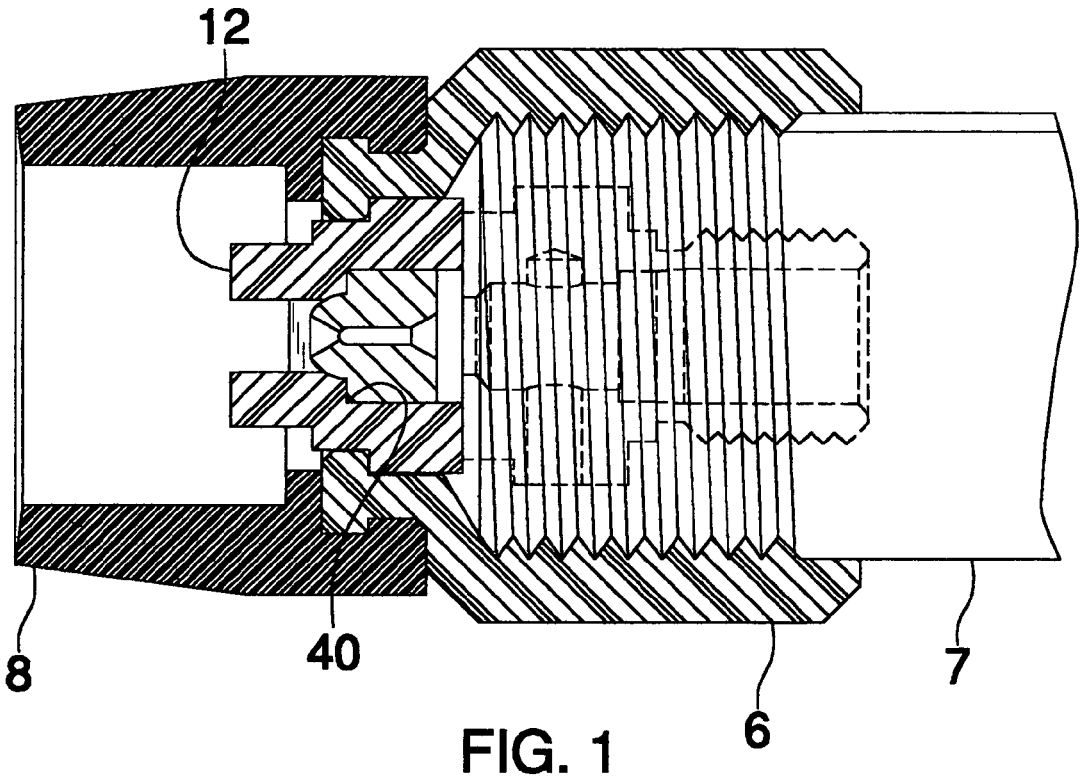
FIG. 1 is a cross-sectional view of a paint spraying nozzle assembly according to the present invention.
Figure 2:
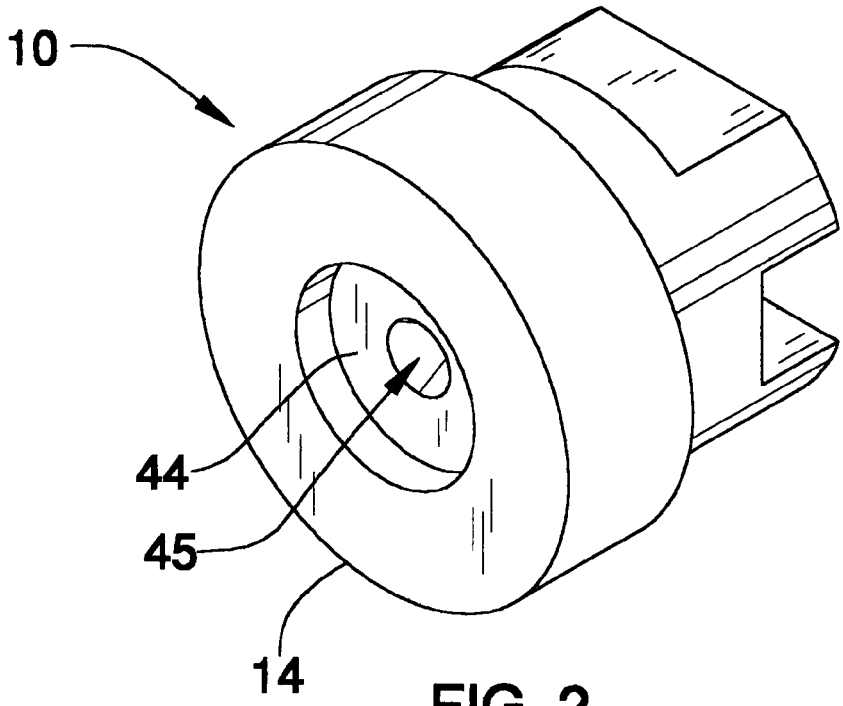
FIG. 2 is a perspective view of the bottom and side of the present invention.
Figure 3:
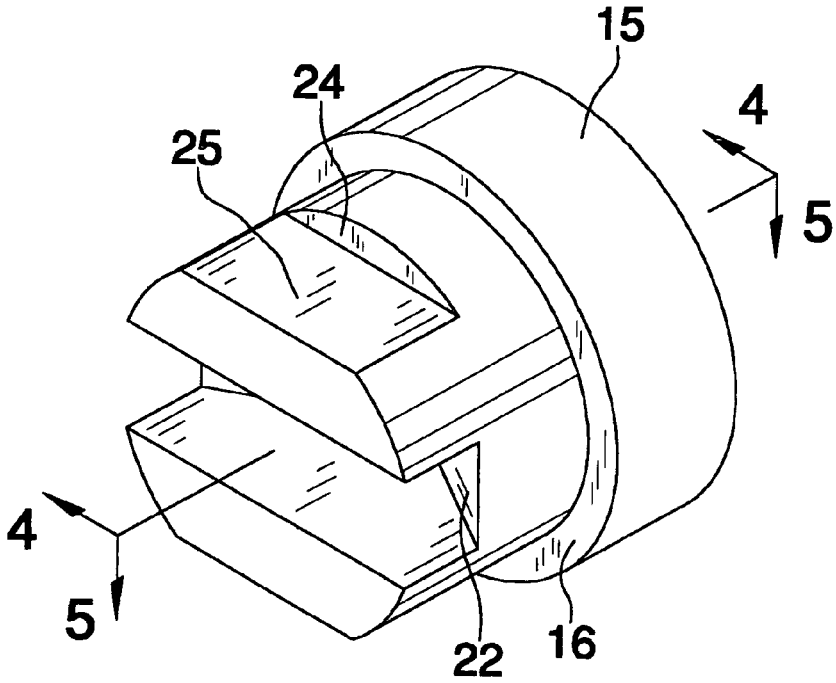
FIG. 3 is a perspective view of the top and side of the present invention.
Figure 4:
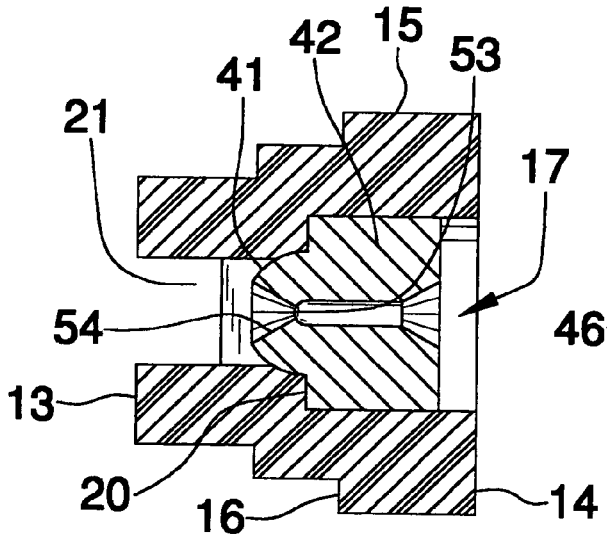
FIG. 4 is a cross-sectional view taken along line 4—4 of FIG. 3 of the present invention.
Figure 5:
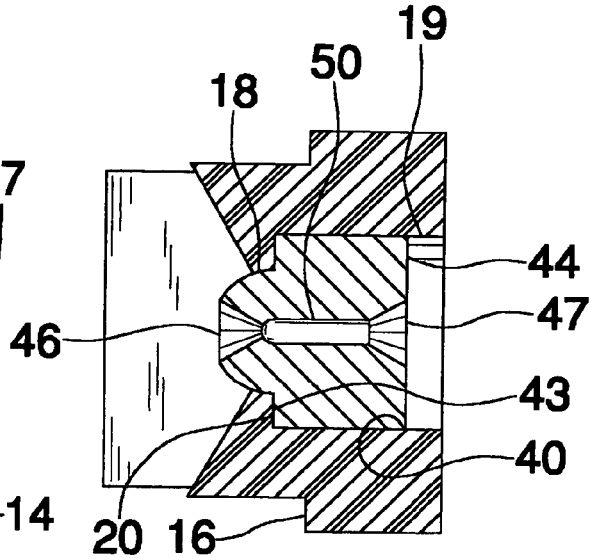
FIG. 5 is a cross-sectional view taken along line 5—5 of FIG. 3 of the present invention.
Figure 6:
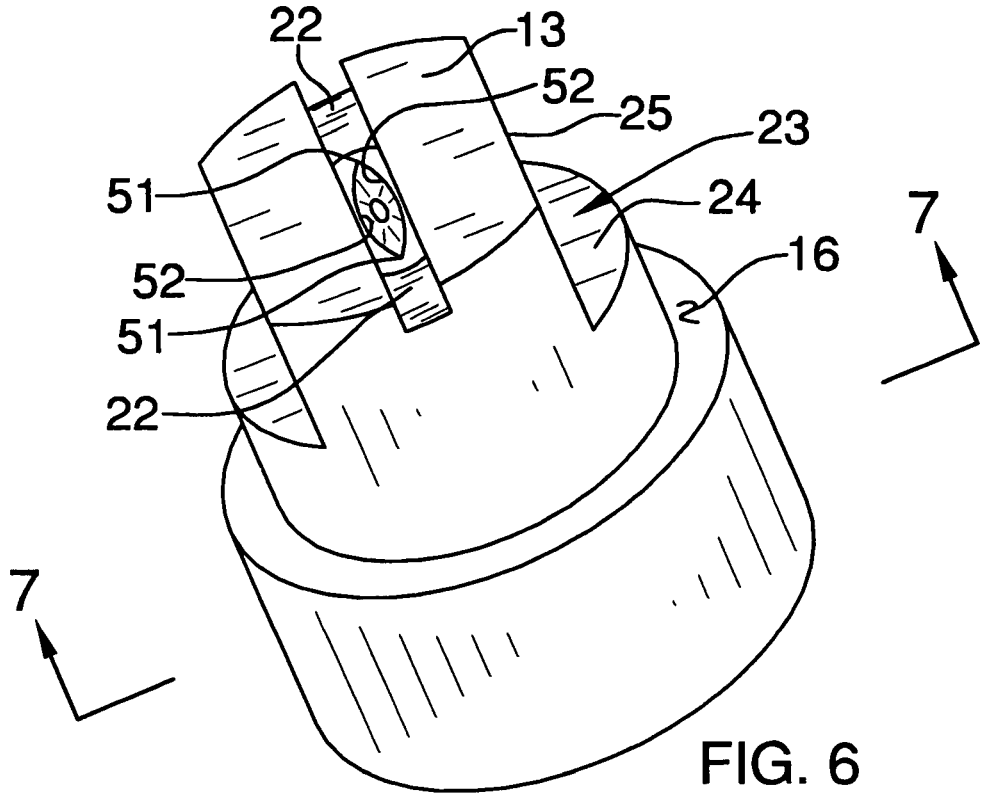
FIG. 6 is a perspective top view of the present invention.

With reference now to the drawings, and in particular to FIGS. 1 through 12 thereof, a new spraying device embodying the principles and concepts of the present invention and generally designated by the reference numeral 10 will be described.

As best illustrated in FIGS. 1 through 12, the paint spraying nozzle assembly 10 generally comprises a nozzle tip for removably positioning within a threaded retaining nut 6 for removably securing to a conventional spray gun head 7. The nut 6 is attached to a conventional nozzle head 8 for aiding in the directing of paint being sprayed outwardly by a spray gun. The assembly 10 aids in the dispersion and atomizing of the paint being ejected from the nozzle head 8 and in particular the atomizing of paint having a fluid pressure of up to 3000 psi.

The assembly 10 includes a generally solid housing 12 having a top wall 13, a bottom wall 14 a peripheral wall 15 that extends between and is attached to the top 13 and bottom walls 14. Each of the top 13 and bottom 14 walls has a circular shape. The peripheral wall 15 has a peripheral outer shoulder 16 therein such that the bottom wall 14 has a greater diameter than the top wall 13. An axially aligned opening 17 extends through the housing 12 and through the bottom 14 and top 13 walls. The opening 17 includes a top portion 18 adjacent to the top wall 13 and a bottom portion 19 adjacent to the bottom wall 14. The bottom portion 19 has a larger diameter with respect to the top portion 18 such that an inner shoulder 20 is defined. A slot 21 extends into the top wall 13 and extends along a diameter of the top wall 13 such that the top portion 18 of the opening 17 opens into the slot 21. It is preferred that a bottom wall 22 of the slot 21 is angled upwardly from the opening 17 in either direction away from the opening 17 and toward the peripheral wall 15. This angle is preferably about equal to 30 degrees with respect to a plane of the top wall 13. A pair of vertical cutouts 23 extends into the top wall 13 and toward the outer shoulder 16 such that a pair of planar surfaces 25 is formed in the peripheral wall 15. A ledge 24 is defined at a bottom edge of each of the planar surfaces 25 and each of the planar surfaces 25 is orientated parallel to the slot 21.

The housing 12 may be constructed according to a multitude of sizes depending on the amount of paint to be atomized, the consistency of the paint, and the shape of the spray designed. However, one of two embodiments is preferred. In each embodiment, the diameter of the bottom wall 14 is generally equal to about 0.60 inches and a diameter of the top wall 13 is generally equal to 0.50 inches. Also, it is preferred that the height of the housing 12 from the bottom wall 14 to the outer shoulder 16 is generally between 0.18 inches and 0.22 inches and preferably equal to about 0.20 inches. These measurements ensure that the housing 12 will fit into a conventional retaining nut. Additionally, these measurements ensure that the housing 12 cannot be positioned in the retaining nut 6 in a backward configuration which could lead to an injury by the nut 6 being shot from the spray gun. The slot 21 has a width generally between 0.120 inches and 0.165 inches and the top portion 18 of the opening 17 has a diameter generally equal to the width of the slot 21. The bottom portion 19 of the opening 17 has a diameter generally between 0.190 inches and 0.30 inches. A distance between the bottom wall 14 and the inner shoulder 20 is generally equal to 0.250 inches.

Figure 7:
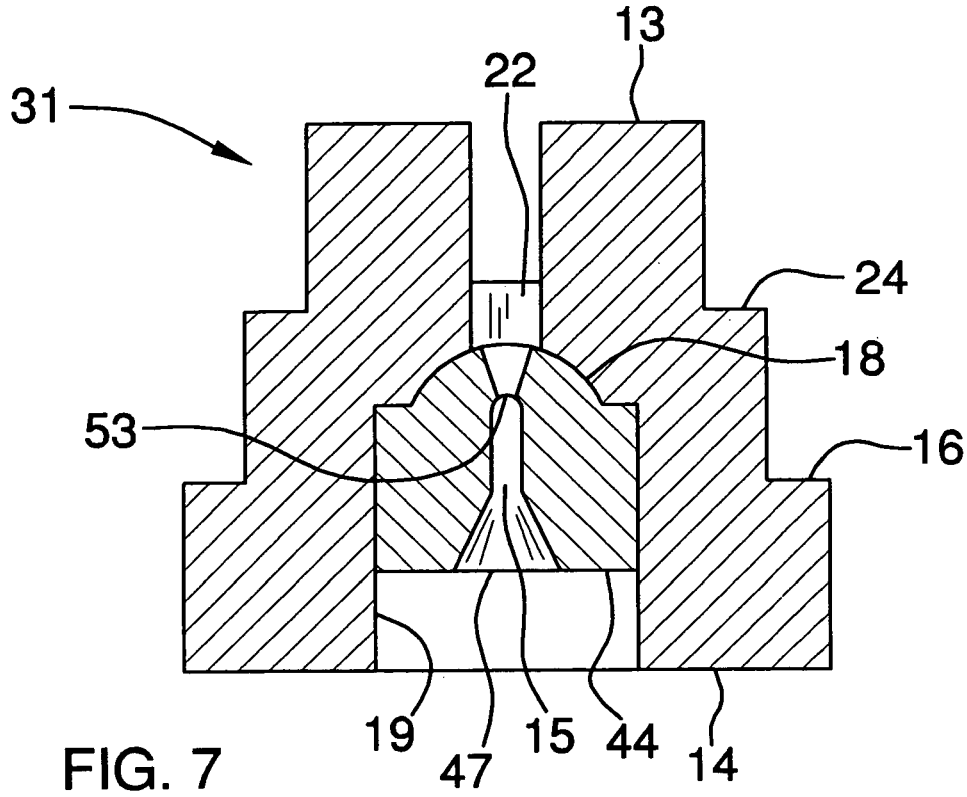
FIG. 7 is a cross-sectional view of the first embodiment of the present invention.
Figure 8:
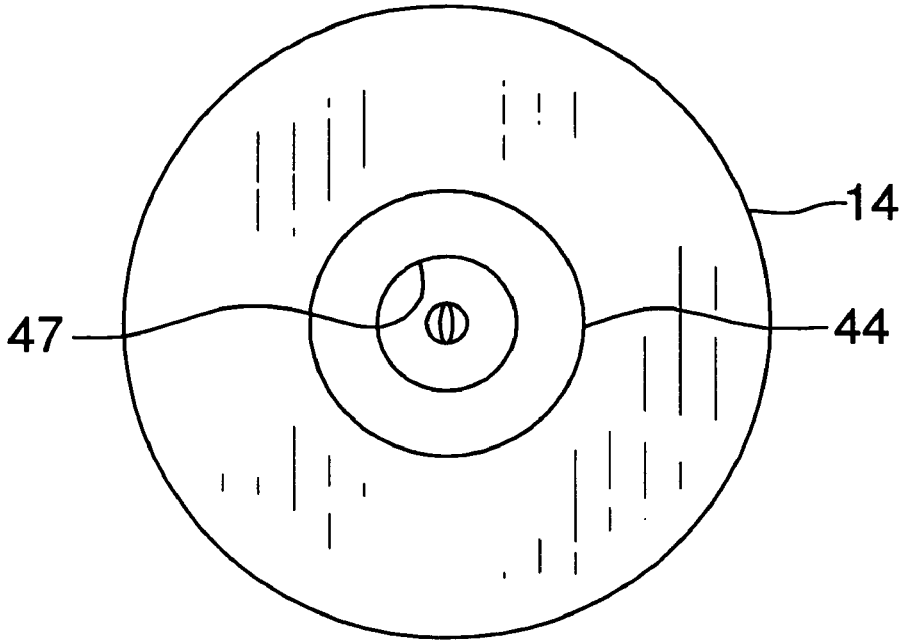
FIG. 8 is a bottom view of the first embodiment of the present invention.
Figure 9:
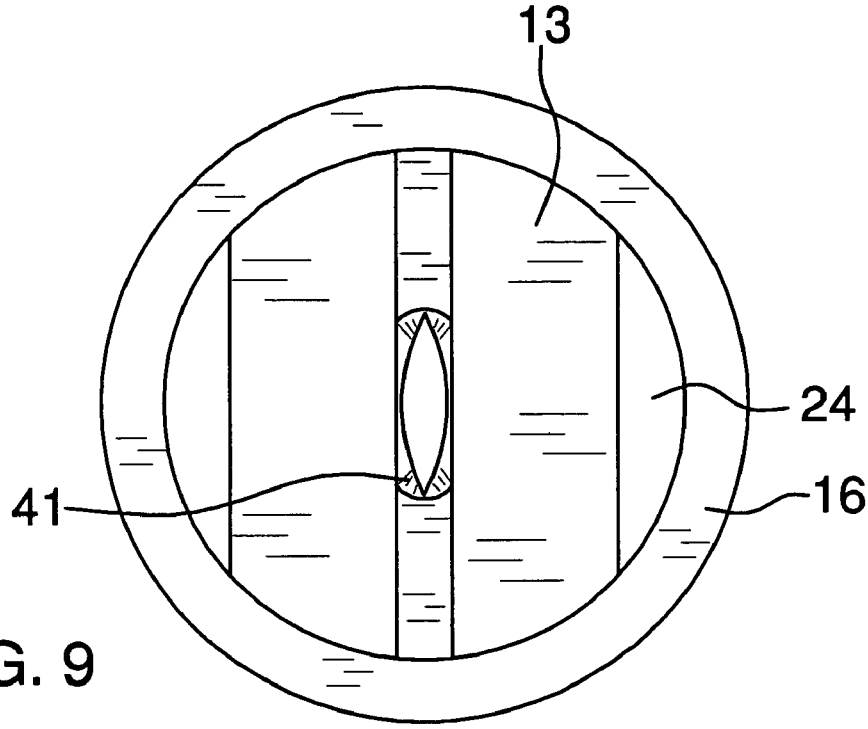
FIG. 9 is a top view of the first embodiment of the present invention.
Figure 10:
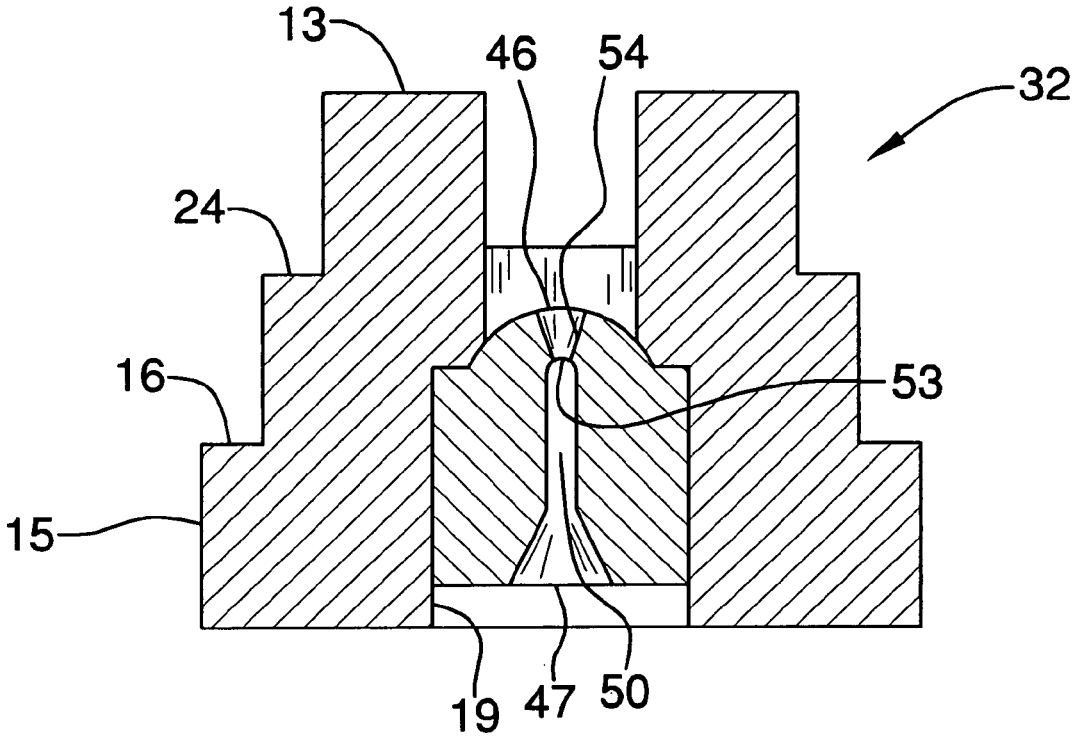
FIG. 10 is a cross-sectional view of the second embodiment of the present invention.
Figure 11:
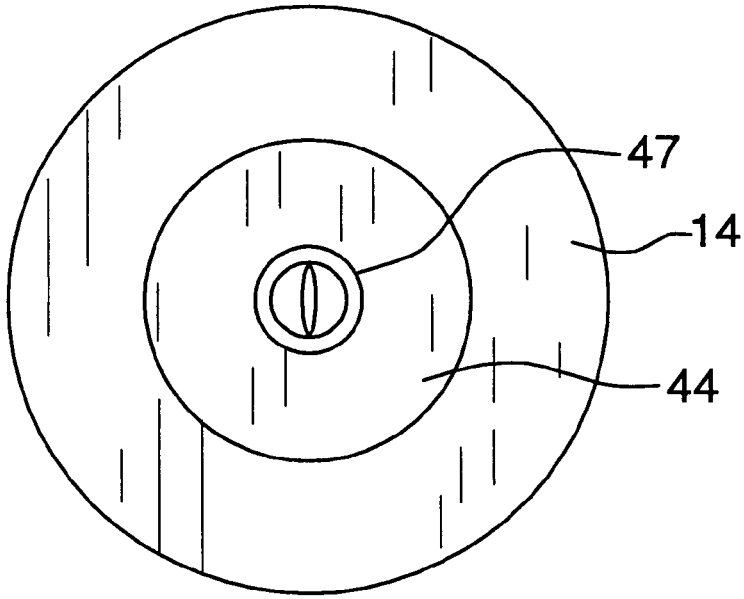
FIG. 11 is a bottom view of the second embodiment of the present invention.
Figure 12:
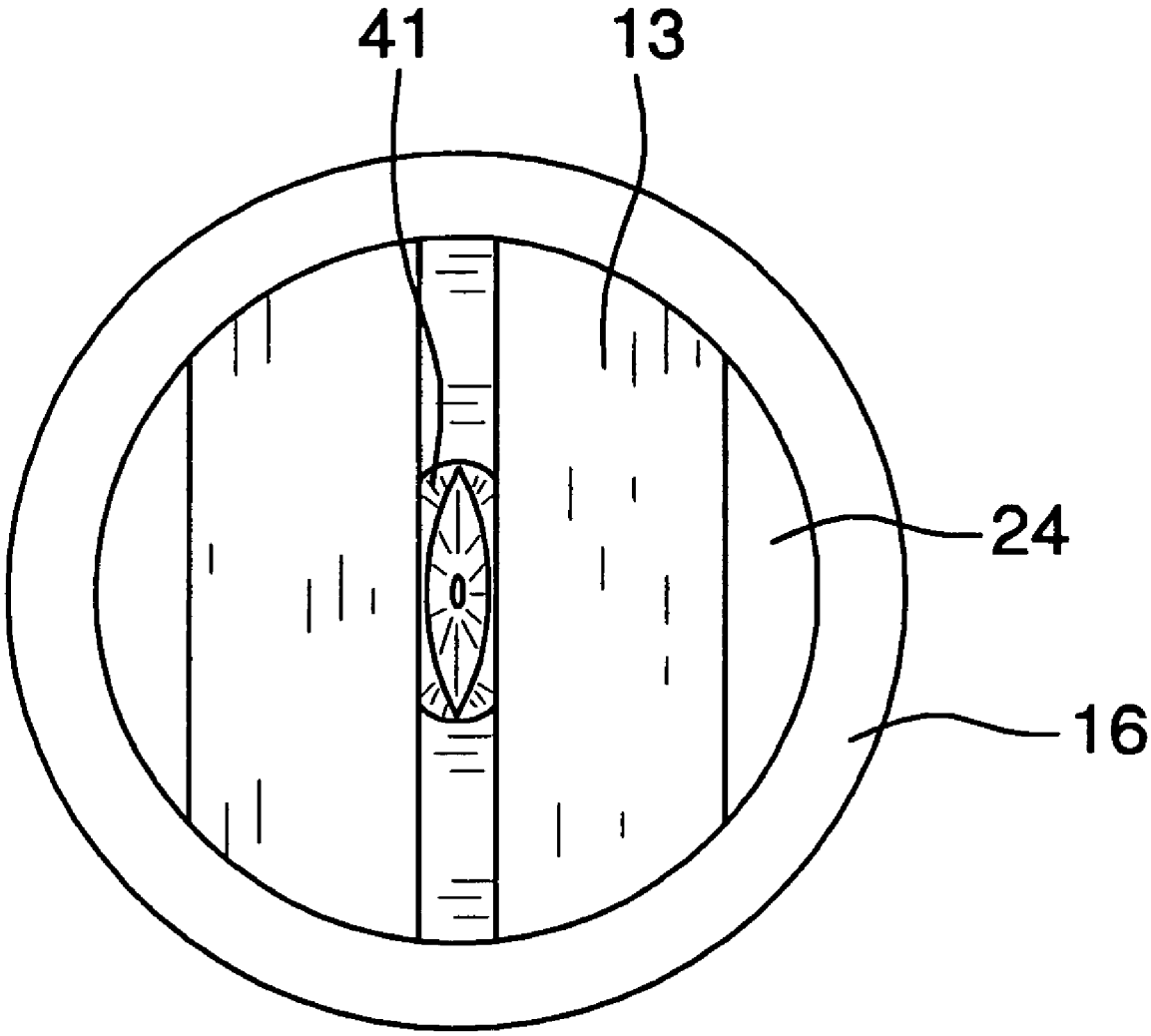
FIG. 12 is a top view of the second embodiment of the present invention.

In the first embodiment 31, as shown in FIGS. 7–9, it is preferred that that the slot 21 has a width between 0.120 inches and 0.130 inches and ideally a width equal to about 0.125 inches. The bottom portion 19 preferably has a diameter between 0.190 inches and 0.20 inches and more preferably equal to about 0.195 inches. As to the second embodiment 31, depicted in FIGS. 10–12, it is preferred that that the slot 21 has a width between 0.155 inches and 0.165 inches and ideally a width equal to about 0.160 inches. The bottom portion 14 preferably has a diameter between 0.280 inches and 0.30 inches and more preferably equal to about 0.290 inches.

The housing 12 is comprised of a plastic material. Plastic is used because it is non-conductive which reduces the chance of electrostatic build-up. Also, by utilizing a plastic, the risk of galvanic corrosion is lessened. This type of corrosion occurs when dissimilar metals are placed in an electrolytic solution. Therefore, a material which does not aid in corrosion will increase the life of the assembly. Any plastic having the above characteristics and the ability to withstand pressures higher than 10,000 psi may be utilized. Though a wide a wide range of polymers may be employed, the preferred plastic polymer is polyphenelene sulfide. This material is available from the Chevron Phillips Chemical Company LP, located at 10001 Six Pines Drive, The Woodlands, Tex. 77380. Information on this material may be found on the Internet at http://www.cpchem.com/rytonpps/whatis.html. In addition to the above characteristics including no galvanic corrosion, this material is low cost, low weight, highly chemically resistant, pressure resistant up to 12,500 psi, and may be obtained in a wide range of colors for color-coding the housings.

An insert 40 is mounted within the opening 17 and abuts the inner shoulder 20. The insert 40 includes an upper section 41 positioned within and having generally the same diameter as the top portion 18 and a lower section 42 positioned within and having generally the same diameter as the bottom portion 19 of the opening 17. This forms a flange 43 between the upper 41 and lower 42 sections. A distance between the flange 43 and a free end 44 of the lower section 42 is preferably between 0.10 inches and 0.20 inches. For the first embodiment 31, this measurement is preferably between 0.10 inches and 0.110 and more preferably equal to about 0.107 inches. For the second embodiment 32, this measurement is preferably between 0.190 inches and 0.20 inches and more preferably equal to 0.195 inches. The bottom portion 19 of the opening 17 extends further away from the inner shoulder 20 than the lower section 42 extends from the inner shoulder 20. This ensures that the insert 40 is located completely within the housing 12. A juncture of the upper 41 and lower 42 sections may be arcuate to match a rounded juncture of the top 18 and bottom 19 portions if such a structure is used. The rounded shape decreases pressure between the insert 40 and the housing 12. The upper section 41 extends into the slot 21 of the housing 12 as shown in the cross-sections of the housing 12.

The insert 40 has a bore 45 extending therethrough and through the upper 41 and lower 42 sections. The bore 45 is generally aligned with an axis of the opening 17. The bore 45 has a top end 46, a bottom end 47 and a middle section 50 positioned therebetween. The top end 46 is adjacent to the slot 21. The bottom end 47 has a diameter generally equal to 0.10 inches. The bore 45 tapers inward from the bottom end 47 to the middle section 50. The angle of tapering is equal to about 60 degrees with respect to a plane of the bottom end 47. The middle section 50 has a diameter generally between 0.007 inches and 0.072 inches. In the first embodiment 31, the middle section 50 preferably has a diameter of 0.007 inches to 0.039 inches and the second embodiment 32 has a diameter from 0.040 inches to 0.072 inches. The top end 46 of the bore 45 is an ovaloid structure having a pair of substantially pointed ends 51 and a pair of arcuate sides 52 extending between the pointed ends 51. This shape is analogous to a "cat's eye" shape.

The top end 46 of the bore 45 has a greatest width between the arcuate sides 52 generally between 0.120 inches and 0.165 inches and a length between the pointed ends 51 generally between 0.150 inches and 0.190 inches. The first embodiment 31 preferably includes a greatest width between 0.120 inches and 0.130 inches and more preferably is equal to about 0.126 inches, and a length between the pointed ends 51 between 0.150 inches and 0.160 inches. The second embodiment 32 preferably includes a greatest width between 0.155 inches and 0.165 inches and more preferably is equal to about 0.160 inches, and a length between the pointed ends 51 between 0.180 inches and 0.190 inches and more preferably is equal to 0.186 inches. A line extending between the pointed ends 51 is orientated generally parallel to the slot 21. The top end 46 tapers to the middle section 50 along an inner perimeter wall of the bore 45. A juncture 53 of the middle section 50 and the inner perimeter wall 54 is preferably concave with respect to the middle section 50 such that the bore 45 narrows at the juncture of the middle section 50 to the inner perimeter wall 54.

The insert 40 is preferably comprised of a metallic material and more preferably comprised a tungsten carbide material. Tungsten carbide materials are ubiquitous in their use and properties depending upon the various alloy mixtures used. A particular tungsten carbide material has not been favorably used over another, though information and supplies on a variety of such materials may be found at the H.B. Carbide Company located at 4210 Doyle Drive, Lewiston, Mich. 49756.

In use, the housing 12 may be positioned in the retaining nut 6 and secured against the spray gun head 7 such that paint ejected outwardly of the spray gun travels through the bore 45 and outward of the slot 21. The assembly performs as the tip of the spray gun and shapes and atomizes the paint as it flows through the bore 45. The shape and construction of the housing 12 ensures that it will not corrode for long life of the housing and insert while also ensuring that will be capable of handling the high pressures required of the spray gun.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A spray nozzle assembly for removably positioning within a threaded retaining nut for removably securing to a spray gun head, said assembly including:

a housing having a top wall, a bottom wall a peripheral wall extending between and being attached to said top and bottom walls, each of said top and bottom walls having a circular shape, said peripheral wall having a peripheral outer shoulder therein such that said bottom wall has a greater diameter than said top wall, said housing having an opening therein extending through said bottom and top walls, said opening including a top portion adjacent to said top wall and a bottom portion adjacent to said bottom wall, said bottom portion having a larger diameter with respect to said top portion such that an inner shoulder is defined, said top wall having a slot extending therein and along a diameter of said top wall such that said top portion of said opening opens into said slot, said housing comprising a plastic material, said diameter of said bottom wall being generally equal to 0.60 inches and a diameter of said top wall is generally equal to 0.50 inches, a height of said housing from said bottom wall to said outer shoulder being between 0.18 inches and 0.22 inches;

an insert being mounted within said opening and abutting said inner shoulder, said insert including an upper section positioned within and having generally the same diameter as said top portion and a lower section positioned within and having generally the same diameter as said bottom portion, said bottom portion extending further away from said inner shoulder than said lower section extends from said inner shoulder, said insert having a bore extending therethrough and through said upper and lower sections, said bore being generally aligned with an axis of said opening, said insert comprising a tungsten carbide material; and wherein said housing may be positioned in the retaining nut and secured against the spray gun head such that paint ejected outwardly of the spray gun travels through said bore and outward of said slot.

2. The assembly according to claim 1, wherein said housing has a pair of vertical cutouts therein, each of said cutouts extending into said top wall and toward said outer shoulder such that a pair of planar surfaces are formed in said peripheral wall, a ledge being defined at a bottom edge of each of said planar surfaces, each of said planar surfaces being orientated parallel to said slot.

3. The assembly according to claim 1, wherein said slot has a width generally between 0.155 inches and 0.165 inches.

4. The assembly according to claim 1, a distance between said bottom wall and said outer shoulder being equal to 0.20 inches.

5. The assembly according to claim 1, wherein said slot has a width generally between 0.120 inches and 0.165 inches.

6. The assembly according to claim 5, said top portion of said opening has a diameter generally equal to said width of said slot.

7. The assembly according to claim 5, wherein said bottom portion of said opening has a diameter generally between 0.190 inches and 0.20 inches.

8. The assembly according to claim 5, wherein said bottom portion of said opening has a diameter generally between 0.28 inches and 0.30 inches.

9. The assembly according to claim 5, wherein said bottom portion of said opening has a diameter generally between 0.190 inches and 0.30 inches.

10. The assembly according to claim 9, a distance between said bottom wall and said outer shoulder being equal to 0.20 inches.

11. The assembly according to claim 10, wherein a distance between said bottom wall and said inner shoulder being generally equal to 0.250 inches.

12. The assembly according to claim 11, wherein said upper section of said insert extends into said slot, said bore having a top end, a bottom end and a middle section positioned therebetween, said top end being adjacent to said slot, said bottom end having a diameter generally equal to 0.10 inches, said bore tapering from said bottom end to said middle section, said middle section having a diameter generally between 0.007 inches and 0.072 inches, said top end of said bore comprising an ovaloid having a pair of substantially pointed ends and a pair of arcuate sides extending between said pointed ends, said top end having a greatest width between said arcuate sides generally between 0.120 inches and 0.165 inches and a length between said pointed ends generally between 0.150 inches and 0.190 inches, a line extending between said pointed ends being orientated generally parallel to said slot, said top end tapering to said middle section along an inner perimeter wall of said bore, said bore narrowing at a juncture of said middle section to said inner perimeter wall.

13. The assembly according to claim 1, wherein said upper section of said insert extends into said slot, said bore having a top end, a bottom end and a middle section positioned therebetween, said top end being adjacent to said slot, said bottom end having a diameter generally equal to 0.10 inches, said bore tapering from said bottom end to said middle section, said middle section having a diameter generally between 0.007 inches and 0.072 inches.

14. The assembly according to claim 13, wherein said middle section has a diameter generally between 0.040 inches and 0.072 inches.

15. The assembly according to claim 13, wherein said top end of said bore comprises an ovaloid having a pair of substantially pointed ends and a pair of arcuate sides extending between said pointed ends, said top end having a greatest width between said arcuate sides generally between 0.120 inches and 0.165 inches and a length between said pointed ends generally between 0.150 inches and 0.190 inches, a line extending between said pointed ends being orientated generally parallel to said slot, said top end tapering to said middle section along an inner perimeter wall of said bore, said bore narrowing at a juncture of said middle section to said inner perimeter wall.

16. The assembly according to claim 13, wherein said greatest width between said arcuate sides is generally between 0.120 inches and 0.130 inches and said length between said pointed ends is generally between 0.150 inches and 0.160 inches.

17. The assembly according to claim 13, wherein said greatest width between said arcuate sides is generally between 0.155 inches and 0.165 inches and said length between said pointed ends is generally between 0.180 inches and 0.190 inches.

18. The assembly according to claim 13, wherein said middle section has a diameter generally between 0.007 inches and 0.039 inches.

* * * * *